United States Patent [19]

Andersson

[11] 4,427,181

[45] Jan. 24, 1984

[54] DEVICE FOR LIFTING LOADS, ESPECIALLY HEAVY LOADS, IN A STEPWISE MANNER BY MEANS OF ONE OR SEVERAL JACKS

[75] Inventor: Bengt V. Andersson, Jakobsgatan 7, S–72464 Västerås, Sweden

[73] Assignee: Bengt Valfrid Andersson, Västerås, Sweden

[21] Appl. No.: 343,806

[22] Filed: Jan. 29, 1982 (Under 37 CFR 1.47)

Related U.S. Application Data

[63] Continuation of Ser. No. 163,858, Jun. 27, 1980, abandoned.

[30] Foreign Application Priority Data

Jul. 5, 1979 [SE] Sweden ..... 7905887

[51] Int. Cl.[3] ..... B66F 1/08

[52] U.S. Cl. ..... 254/108

[58] Field of Search ..... 254/29 R, 30, 31, 89 H, 254/89 R, 105, 106, 107, 108, 109, 110, 111

[56] References Cited

U.S. PATENT DOCUMENTS 3,396,944 8/1968 Jansz ..... 254/105
3,416,284 12/1968 Adler ..... 254/106
3,881,687 5/1975 Johansson ..... 254/108
3,895,778 7/1975 Ahlgren ..... 254/106

*Primary Examiner*—Robert C. Watson
*Attorney, Agent, or Firm*—Pollock, Vande Sande & Priddy

[57] ABSTRACT

A device for stepwise lifting heavy loads, wherein one or more units each consists of a vertical support member resting on a rigid bed and accommodating a lifting member vertically displaceable in the support member; supporting elements shorter than the length of displacement of the lifting member, one such supporting element being insertable into the support member above the lifting member in its lowered position in order, upon upward displacement of the lifting member, to be introduced into a vertical guiding tube aligned with the support member, the load resting on top of the uppermost supporting element in the guiding tube; and a support plate insertable between the guiding tube and the support member in engagement with the top end surface of the latter, the support plate permitting vertical displacement of the supporting element resting on the lifting member when the supporting element is situated partly within the support member, but preventing downward displacement of the supporting element when it is completely inserted into the guiding tube.

6 Claims, 4 Drawing Figures

DEVICE FOR LIFTING LOADS, ESPECIALLY HEAVY LOADS, IN A STEPWISE MANNER BY MEANS OF ONE OR SEVERAL JACKS

This is a continuation of application Ser. No. 163,858, filed June 27, 1980 now abandoned.

The present invention concerns a device for lifting loads, especially heavy loads, in a stepwise manner by means of one or several jacks.

In prior art devices of this kind one or more so-called climbing jacks are used, i.e., a jack which cooperates with an elongated vertical carrying member and upon retraction and elongation alternately lifts the load and is moved stepwise along the carrying member. An example of such a device is shown in Swedish Patent No. 363,798.

However, devices which incorporate climbing jacks have serious drawbacks. The need to provide the carrying member with a great number of support means for the jack as well as for the load, and the need to dimension the carrying member so that it can support the load, entails substantial costs. The fact that the jack during the lifting procedure is moved upwards along the carrying member furthermore makes it necessary to provide long supply conduits for the hydraulic fluid, when the jack is of a hydraulic type, which, apart from increasing the costs, clutters up the work site and may cause accidents, and which also increases the risks of damage to the conduits. The greatest disadvantage, however, is that, because of the construction of the devices, the work crew must accompany the load, at great risk of injury. This condition has also brought about strict safety regulations and insurance demands, constituting a serious economic drawback.

The object of the present invention is therefore to provide a device of the type described by means of which the above stated disadvantages are overcome.

Figure 1:
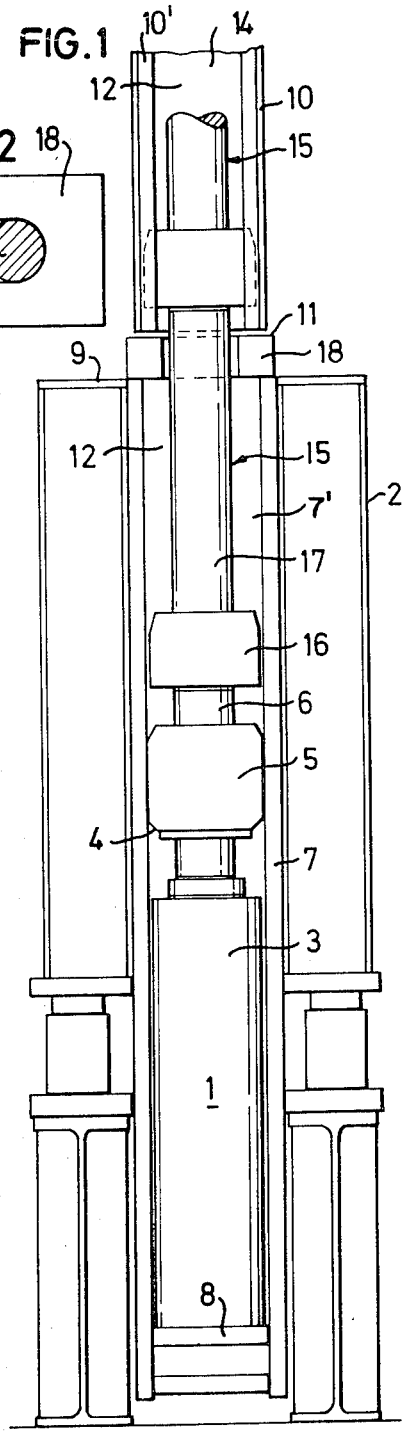
Figure 2:
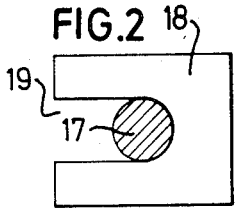
Figure 4:
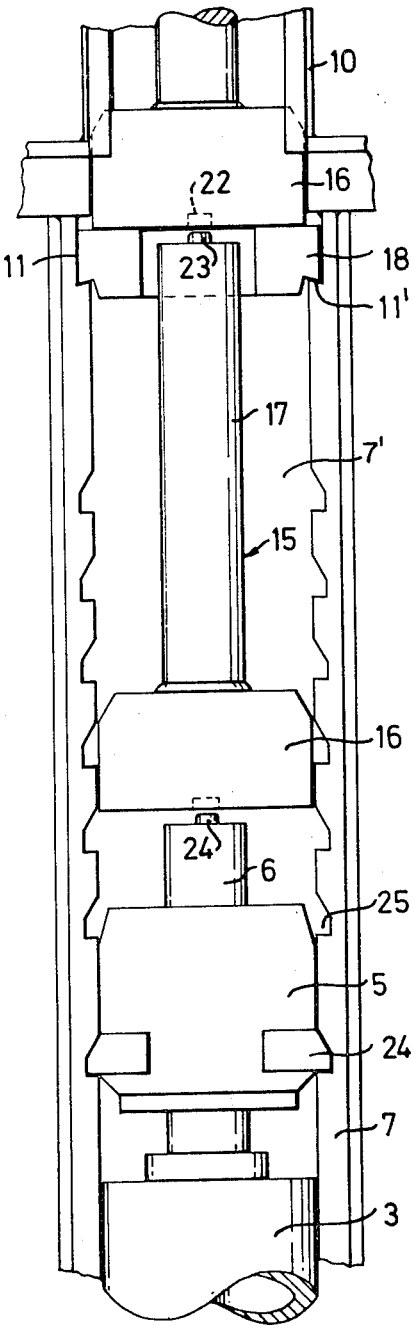
Figure 3:
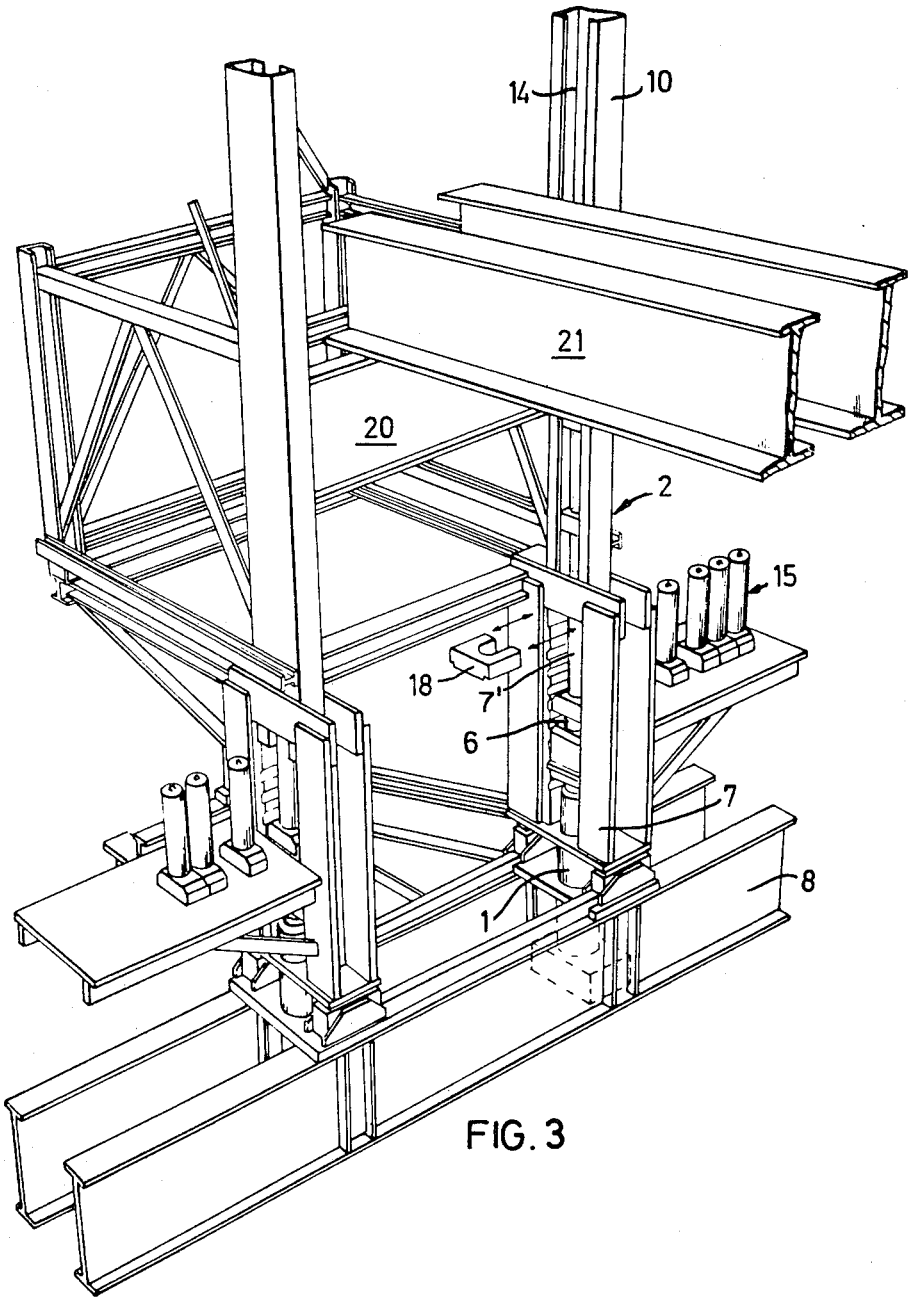

In order that the invention may be more clearly understood, reference will now be made to the accompanying drawings, wherein several embodiments of the invention are shown for purposes of illustration, and wherein:

FIG. 1 is a front elevation of a portion of a device according to the invention, FIG. 2 is a plan view of a support plate forming a part of the device, FIG. 3 is an isometric view of two devices or units according to the invention while lifting a load, and FIG. 4 is a view corresponding to FIG. 1 and showing a second embodiment according to the invention.

As shown in the drawings the device or unit for a stepwise lifting of the load comprises a jack 1 and an elongated, vertically upright mast 2. The jack 1 is of conventional construction, including a support portion 3 and a lifting portion 4 which is extendable out of and retractable into said support portion 3. The jack 1 is preferably actuated by means of hydraulic fluid, but a mechanically operated jack may also be used. At the top end the lifting portion 4 can be provided with a head 5, which has a special construction known per se and is intended to prevent unintentional retraction of the jack, e.g., upon failure of the hydraulic conduits, as will be further described later on. The top side of the head 5 is furthermore provided with a central projection or a stud 6 having a smaller cross section than the head 5. The function of the projection or stud will be described below.

The elongated vertically upright mast 2 includes a scaffold or frame which is not shown in detail, since it does not form any part of the invention and may be designed in a manner suitable for the prevailing conditions, e.g., in the form of a frame-work construction. The object of the scaffold is to retain the remaining portion of the mast in rigid vertically upright position. Said remaining portion comprises a support member 7 in the form of a tube, preferably of square cross-section, or a U-beam which by said scaffold is held in vertical position, whereby the bottom end of the support member 7 rests on a bed 8 or the like, which is rigid enough to support the device and the load lifted thereby. The support member 7 is meant to surround said jack 1 at some distance therefrom, whereby the support portion 3 of the jack 1 rests on said bed 8. The support member 7 a length which is somewhat smaller than the maximum length of the jack 1 in its fully extended lifting position, so that at least a portion of the projection or stud 6 in this position protrudes up over the top plane edge surface 9 of the support member 7.

A support member 7 formed by a U-beam is open along one side and, if the support member 7 consists of a tube, it is provided with a lateral opening 7' extending from the top end of said support member at least to a plane flush with the top end of the projection 6 of the jack head 5.

The remaining portion of the mast 2 comprises a guiding tube 10 which is supported by the mast scaffold in a vertically upright position coaxially above the support member 7, whereby the bottom end edge thereof is situated at a distance from the top edge surface 9 of said support member 7, so that a slot 11 is formed between said surfaces. The guiding tube 10 preferably has the same cross sectional shape as the support member 7, and the internal cross section and area thereof correspond to those of the support member 7, so that a guide passage 12 is formed which runs through the support member 7 and the guiding tube 10. One side wall of the guiding tube 10 is provided with a slot 14 extending over the entire length of said guiding tube. The guiding tube 10 may for instance consist of a U-beam of the same cross sectional shape as the support member 7, rails 10' being secured to the internal longitudinal edges of the flanges of the U-beam, so that the slot 14 is defined by said rails 10'. A second slot 14 may possibly be provided along the opposite side wall of the guiding tube.

The device according to the invention also comprises a number of supporting elements 15. Each supporting element 15 comprises an end plate 16 of such form and dimension that it is displaceable with some play through the guide passage 12 formed by said support member 7 and said guiding tube 10. A column 17 is arranged centrally on one side surface of said end plate 16 and extends perpendicularly out therefrom. The cross section of said column 17 is smaller than the cross section of said end plate 16. The end plate 16 and the column 17 are rigidly interconnected or integral with each other and the overall length of the supporting element 15 is somewhat smaller than the length of a stroke of said jack 1.

Finally, the device according to the invention includes a support plate 18 which is insertable into the slot 11 between the top end of the support member 7 and the adjacent end of the guiding tube 10. The support plate 18 has such dimensions that in its inserted position it rests firmly on the top edge surface 9 of the support member 7 and it is provided with an edge indentation 19 which is of such form and dimension that in the inserted position of the support plate 18 it loosely embraces the column 17 of a supporting element 15 situated within the guiding passage 12 but does not allow the end plate 16 of said supporting element to pass.

However, it is not absolutely necessary that the edge surface 9 of the support member 7 forms the abutment for the support plate 18. In the embodiment shown in FIG. 4, the walls of the support member 7 defining the lateral opening 7' are provided with horizontal grooves or incisions which together define the gap 11 and the bottom edges 11' of which form the abutment for the support plate 18. Said edges 11' may incline downwardly and outwardly, the downwardly directed side face of the support plate 18 being provided with a corresponding chamfer at cooperating edges to prevent the side walls of the support member 7 from being forced apart under the influence of the load.

When the invented device is to be used to lift a load, a number of masts 2 of the kind described is erected on the work site and thereafter a jack 1 is placed in the support member 7 of each mast so that it rests against the bed 8. It, for instance be assumed that the load is to be lifted by means of four units or devices according to the invention. Said units are then placed in the corners of a rectangle with the slots 14 of the guiding tubes 10 pairwise turned towards each other, whereafter a carrying beam 20 is placed with its ends inserted into said slots 14 to rest on the support plate 18 of the corresponding unit. The load 21 is thereafter placed on the two parallel carrying beams 20. Such a pair of units is shown in FIG. 3.

From this starting position, the lifting of the load 21 is commenced in that the lifting portions 4 of the four jacks 1 are completely retracted within the support portions 3 thereof, whereafter a supporting element 15 is inserted into each support member 7 through the lateral opening 7' thereof, in such a manner that the end plate 16 of the supporting element 15 rests on the top end of the lifting portion 4 of the cooperating jack 1.

A suitable number of supporting elements 15 may preferably be placed on a horizontal slide way 15' arranged beside each mast 2 at such a level that said supporting element 15 one after the other can be inserted into each corresponding support member 7. By simultaneous and controlled supply of hydraulic fluid to the jacks 1, their lifting portions 4 are synchronously forced upwards so that the columns 17 of the supporting elements 15 are pushed upwards through the edge indentations 19 of the cooperating support plates 18 to lift the carrying beams 20 and the load 21 thereon. When the carrying beams 20 have been lifted away from the support plates 18, the latter can be pulled out of their gaps 11 since the edge indentations 19 with play accommodate the columns 17 of the supporting elements 15. A retainer or the like (not shown) may be arranged at the top end of each support member 7 slidably to receive the support plate 18 thereof when the same is pulled out of the gap 11. In this position the carrying beams 20 and the load 21 are completely supported by the jacks 1 and the supporting elements 15 and can be lifted further by extension of the jacks 1, until the supporting elements 15 have been completely pushed out of the corresponding support members 7 and into the guiding tubes 10 with the bottom end surfaces of the end plates 16 a short distance above the top border surface of the gaps 11. In this position the support plates 18 are reinserted into their corresponding gaps 11, whereby the projections or studs 6 of the jack heads 5, which preferably have the same cross section dimension as the columns 17 of the supporting elements 15, are accommodated in the edge indentations 19 of the support plates 18. By reversing the supply of hydraulic fluid to the jacks 1, which preferably are double-acting, the latter are retracted so that the supporting elements 15 together with the carrying beams 20 and the load 21 are lowered until the end plates 16 of the supporting elements 15 rest against said support plates 18. When the jacks 1 have been completely retracted, a new supporting element 15 is inserted into each support member 7 through the lateral opening 7' thereof, whereafter the above described procedure is repeated. In this way the load 21 may be lifted stepwise to the required level, the height of each lifting step corresponding to the length of the supporting element 15 used.

The axial length of the end plate 16 of each supporting element 15 is preferably greater than the width of the gap 11, so that the top end of the end plate 16 is inserted into the guiding tube 10 before the bottom end thereof is pushed out of the corresponding support member 7. Each supporting element is thereby effectively guided in the guiding passage 12 during the whole lifting step. Each supporting element 15 can also be provided with a central blind hole 22 (see FIG. 4) in the end surface of the end plate 16 and a corresponding pin 23 can be arranged on the top surface of the column 17 for engagement in the blind hole 22 of the overlying supporting element 15 in order to maintain the consecutive supporting elements 15 centered. A similar pin 23 is preferably arranged for the same purpose on the top surface of the projection 6 of the jack head 5.

By means of one or several units of this kind, very great loads may thus be lifted to considerable heights. In this connection it should be pointed out that the guiding tube 10 does not have any load supporting function, but only serves as a guide for the supporting elements 15 stacked on top of each other. The guiding tube 10 may therefore be of comparatively weak dimensions, while the support member 7, the jacks 1 and the supporting elements 15 as well as the support plates 18, which carry the whole load, must be dimensioned for the actual load to be lifted.

As a safety measure to prevent unintentional lowering of the load if a jack 1 should be retracted, for instance on account of a rupture in a supply conduit for hydraulic fluid, the head 5 of each jack 1 may be provided with two jaws 24 (FIG. 4) arranged horizontally in a common plane and displaceable towards and from each other by means of resilient forces, the force to drive said jaws 24 apart being derived, for example, from a compression spring tensioned between said jaws 24. The outer edges of said jaws 24 are formed to cooperate with mutually facing horizontal grooves 25 arranged in the side surfaces of the support member 7. The grooves are pairwise situated opposite each other and the top edges thereof are preferably chamfered to coact with corresponding chamfered edges of the jaws 24. When the jack 1 is extended, the jaws 24 are thereby forced towards each other by means of the cooperation between said chamfered edges, so that said jaws are automatically forced out of one pair of grooves and engage the next higher situated pair of grooves under the influence of the compression spring. Should a rupture occur in the supply conduit, the jack head 5 can thus sink only a distance corresponding to the distance between two consecutive pairs of grooves. During an intentional retraction of the jack 1, the jaws 24 are maintained in a position displaced towards each other, for instance by means of a hydraulic cylinder acting between said jaws. The lower edges of the grooves 25 and the corresponding edges of the jaws 24 may also be chamfered in the same way and for the same purpose as the bottom edges 11' of the gap 11 and the corresponding edges of the support plates 18.

The above described device according to the invention is only one of several possible embodiments which lie within the scope of the invention. For example, it is not essential to place the jack 1 of the device within the support member 7. Said support member 7 may instead be provided with a lifting member, preferably having the same form as the jack head 5 with the projection 6, shown in the drawings, which lifting member by means of a jack arranged outside of the support member is displaced up and down in said support member to lift and lower one or several supporting elements 15 in the manner described above. Said lifting member may also be provided with jaws 24 as shown in FIG. 4 to prevent unintentional lowering of the load, as set for hereinabove.

What I claim is:

1. A device for stepwise lifting of loads, especially heavy loads, by means of a jack, said device comprising (a) a vertically upright, tubular support member which rests on a rigid bed and accomodates a lifting member displaceable within said support member by means of said jack between a lowered position and a raised position, the top end surface of said support member being situated below the top end surface of said lifting member in its raised position;

(b) a plurality of supporting elements the length of which is less than the length of displacement of said lifting member, said supporting elements being insertable into said support member between the top end surface of said lifting member in the lowered position thereof and the top end surface of said support member, whereby each inserted supporting element upon displacement of said lifting member to the raised position thereof is moved through said support member past the top end surface thereof so as to form a load carrying stack of supporting elements;

(c) a support plate insertable into engagement with said support member at the top end thereof above a supporting element accommodated therein, said support plate being formed in such a manner that when inserted it permits upward displacement of a supporting element when the same is partly situated within said support member, but prevents downward movement of said supporting element when the same has been raised above the top end surface of said support member; and (d) a vertically upright guiding tube aligned with said support member at a distance above said support plate, when inserted, in order to enclose said stack of supporting elements to prevent horizontal movement thereof and of individual supporting elements inserted therein, the entire weight of the load being carried by said stack.

2. A device as claimed in claim 1, wherein said lifting member comprises the head of a jack, arranged within said support member.

3. A device as claimed in claim 1, wherein said support member comprises a beam which is slotted on one of its sides from the top edge thereof over a length which at least corresponds to the length of stroke of said jack.

4. A device as claimed in any one of claims 1, 2 or 3, wherein each supporting element comprises an end plate which is freely displaceable in said support member and guiding tube, and a vertical column arranged centrally in said end plate and having a substantially smaller cross section than said guiding tube, said support plate having an edge indentation which loosely embraces said vertical column.

5. A device as claimed in any one of claims 1, 2 or 3, wherein each supporting element at one end is provided with a recess and at the other end with a projecting pin for mutual centering of two adjacent supporting elements.

6. A device as claimed in any one of claims 1, 2 or 3, comprising horizontal grooves on the inside of said support member at least within the top portion thereof, said grooves being arranged opposite each other in pairs, said lifting member being provided with two jaws, situated opposite each other and vertically displaceable into and out of engagement with an optional pair of grooves.

* * * * *